US012642397B2

(12) United States Patent
Bates et al.

(10) Patent No.: US 12,642,397 B2
(45) Date of Patent: Jun. 2, 2026

(54) SHOWER BASE

(71) Applicant: Project Soak, LLC, Irving, TX (US)

(72) Inventors: Cory Bates, Arlington, TX (US); William Peck, Arlington, TX (US)

(73) Assignee: Project Soak, LLC, Irving, TX (US)

( * ) Notice: Subject to any disclaimer, the term of this patent is extended or adjusted under 35 U.S.C. 154(b) by 100 days.

(21) Appl. No.: 17/798,403

(22) PCT Filed: Feb. 12, 2021

(86) PCT No.: PCT/US2021/017791
§ 371 (c)(1),
(2) Date: Aug. 9, 2022

(87) PCT Pub. No.: WO2021/163431
PCT Pub. Date: Aug. 19, 2021

(65) Prior Publication Data

US 2023/0092266 A1 Mar. 23, 2023

Related U.S. Application Data

(60) Provisional application No. 62/976,401, filed on Feb. 14, 2020.

(51) Int. Cl.
*A47K 3/40* (2006.01)
*E03F 5/04* (2006.01)

(52) U.S. Cl.
CPC ..... *A47K 3/40* (2013.01); *E03F 5/0408* (2013.01)

(58) Field of Classification Search
CPC ..... A47K 3/40; E03F 5/0408
See application file for complete search history.

(56) References Cited

U.S. PATENT DOCUMENTS

| | | | | |
|---|---|---|---|---|
| 9,462,916 | B2 * | 10/2016 | Adams | A47K 3/40 |
| 2008/0222793 | A1 | 9/2008 | Cook | |
| 2012/0036630 | A1 * | 2/2012 | Cook | E03F 5/0408 4/679 |
| 2013/0276226 | A1 | 10/2013 | Cook et al. | |
| 2014/0201902 | A1 * | 7/2014 | Stimpson | A47K 3/40 4/613 |
| 2017/0211267 | A1 * | 7/2017 | Stonecipher | E03F 5/0408 |
| 2019/0169831 | A1 * | 6/2019 | Wadaga | E03F 5/0408 |
| 2019/0169860 | A1 | 6/2019 | Gomo et al. | |
| 2019/0211540 | A1 * | 7/2019 | Bernoti | E03F 5/0408 |

OTHER PUBLICATIONS

PCT/US2021/017791 International Search Report and Written Opinion dated Apr. 14, 2021.

* cited by examiner

*Primary Examiner* — Christine J Skubinna
(74) *Attorney, Agent, or Firm* — Bradley Arant Boult Cummings LLP; Phillip E. Walker; Alex H. Huffstutter

(57) ABSTRACT

A shower base assembly, comprising a shower base having a length and a width; a drainage channel disposed in the shower base; a drain outlet disposed in the drainage channel; and a drain cover configured to cover the drainage channel, wherein the drainage channel comprises a first edge and a second edge defining a drainage channel length, the drainage channel comprises a third edge and a fourth edge defining a drainage channel width, and the drain outlet is disposed in the drainage channel off-center along the drainage channel length.

20 Claims, 4 Drawing Sheets

SHOWER BASE

The disclosure is directed towards a shower base comprising an off-center drain for ease of installation during bathroom remodeling.

BACKGROUND

Typically, a home bathroom may have a 60 inch by 30 inch, a 60 inch by 32 inch, or a 72 inch by 48 inch tub or shower base. In an event a remodel project might require a larger shower, waste outlet plumbing needs to be moved in order to align with a drain outlet of a new shower base.

Desired is a shower base for remodel and renovation projects, wherein the shower base is larger or smaller than the tub or shower being replaced, and wherein waste outlet plumbing does not need to be moved for installation of the new shower base.

SUMMARY

Accordingly, disclosed is a shower base assembly, comprising a shower base having a length and a width; a drainage channel disposed in the shower base; a drain outlet disposed in the drainage channel; and a drain cover configured to cover the drainage channel, wherein the drainage channel comprises a first edge and a second edge defining a drainage channel length, the drainage channel comprises a third edge and a fourth edge defining a drainage channel width, and the drain outlet is disposed in the drainage channel off-center along the drainage channel length.

In some embodiments, the drainage channel first edge may be adjacent a first side of the shower base, and the drainage channel second edge may be adjacent a second side of the shower base.

In some embodiments, the drainage channel may be substantially centered in the shower base. In this embodiment, a drainage channel length and width may be centered along a shower base length and width, respectively; or, a drainage channel length and width may be centered along a shower base width and length, respectively.

BRIEF DESCRIPTION OF THE DRAWINGS

The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DESCRIPTION

Figure 1:
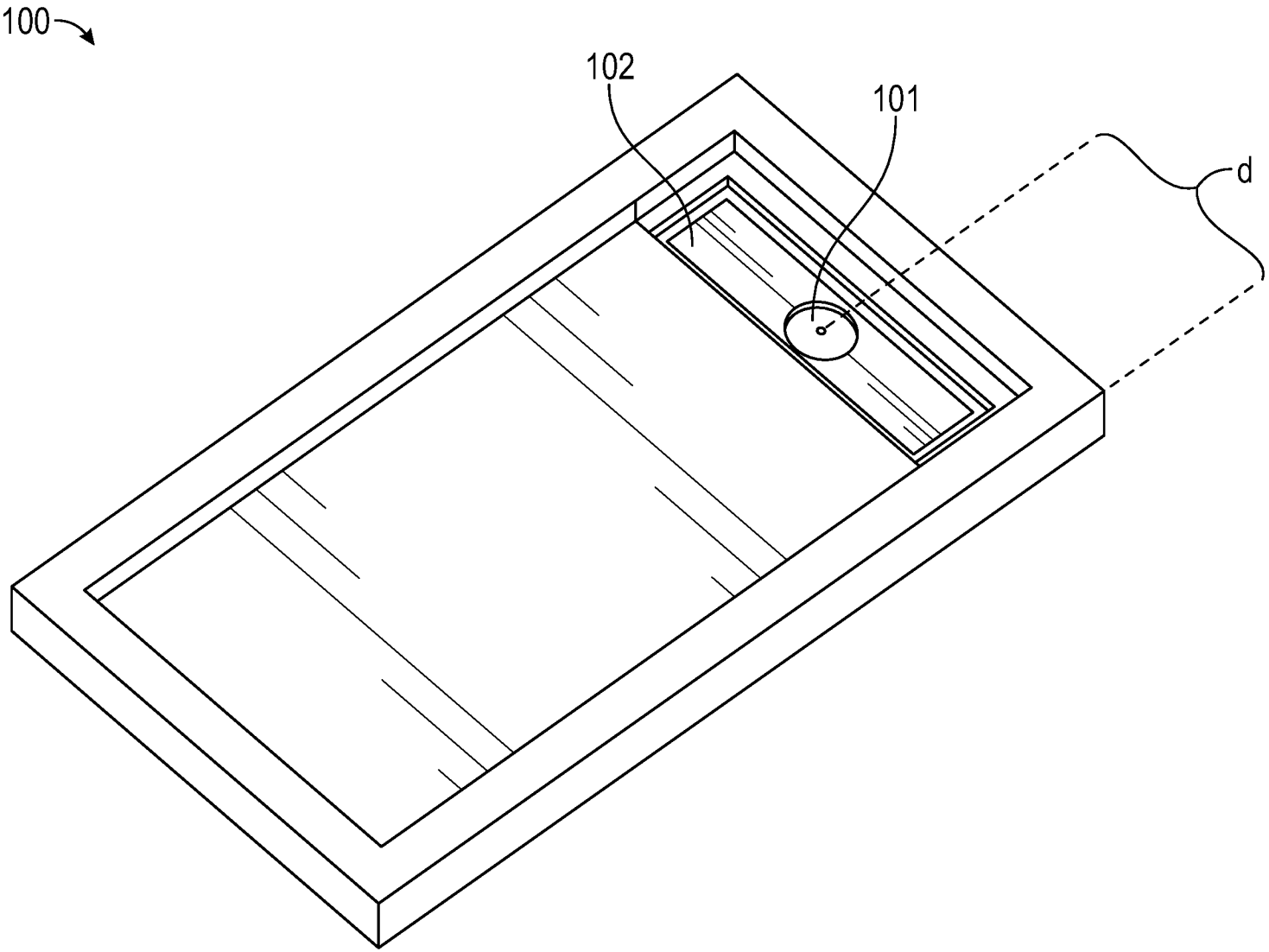
FIG. 1 shows a shower base having a centered drain outlet, according to an embodiment.

FIG. 1 depicts shower base 100 having drain outlet 101. Drain outlet 101 is positioned in drainage channel or "trench" 102, and is substantially centered in channel 102 and along a width of shower base 100. Shower base 100 may be 60 inches×32 inches, wherein drain outlet 101 is substantially centered across the width of shower base 100, or wherein distance d is about 16 inches. Drain outlet 101 is also substantially centered along the length of drainage channel 102. Channel 102 is substantially symmetrically sloped towards drain 101 along its width and length.

Figure 2:
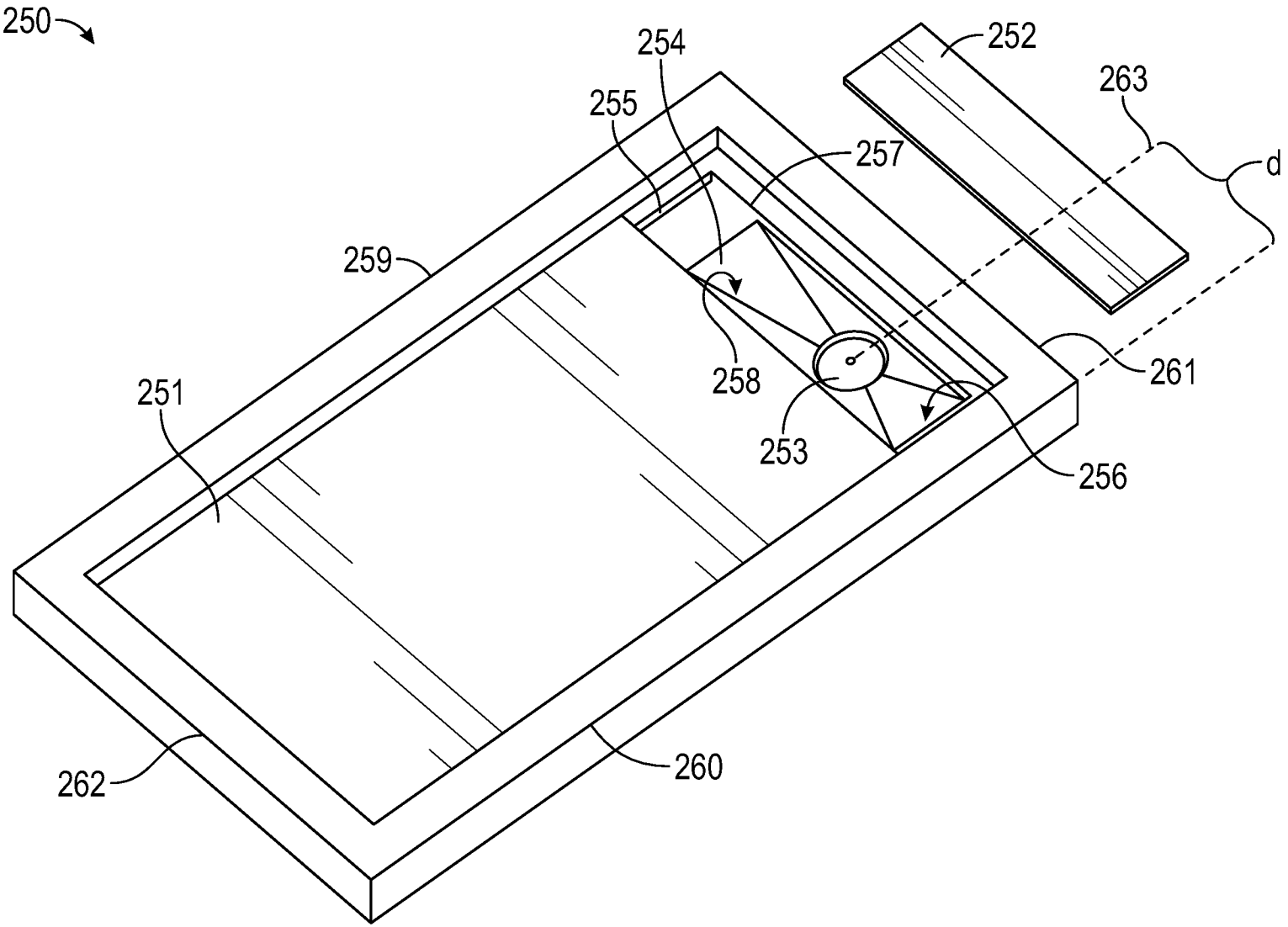
FIG. 2 shows a shower base assembly having an off-center drain outlet, according to an embodiment.

FIG. 2 shows shower base assembly 250 of the invention, according to an embodiment. Shower base assembly 250 includes shower base 251 and drain cover 252. Shower base 251 comprises drain outlet 253 positioned in drainage channel 254. Drainage channel 254 comprises first edge 255, second edge 256, third edge 257, and fourth edge 258. Drainage channel first edge 255 is adjacent shower base first side 259 and drainage channel second edge 256 is adjacent shower base second side 260. Drainage channel third edge 257 is adjacent shower base third side 261 and is distal to shower base fourth side 262. Drain cover 252 may be removably coupled to shower base 251 to cover drain channel 254. Shower base assembly 250 may be 36 inches wide. Drain outlet 253 comprises center line 263, having a distance d of about 16 inches from an outer edge of shower base second side 260, the same as in FIG. 1. Drain outlet 253 is off-center and is about 4 inches closer to shower base second side 260 than to shower base first side 259. Accordingly, a four inch wider shower base 251 may replace shower base 100 without moving any waste plumbing configured to couple to a shower base drain outlet. Drain cover 252 may couple to shower base 251 so that off-center drain outlet 253 is not visible. Drain cover 252 may be removed for cleaning.

Figure 3C:
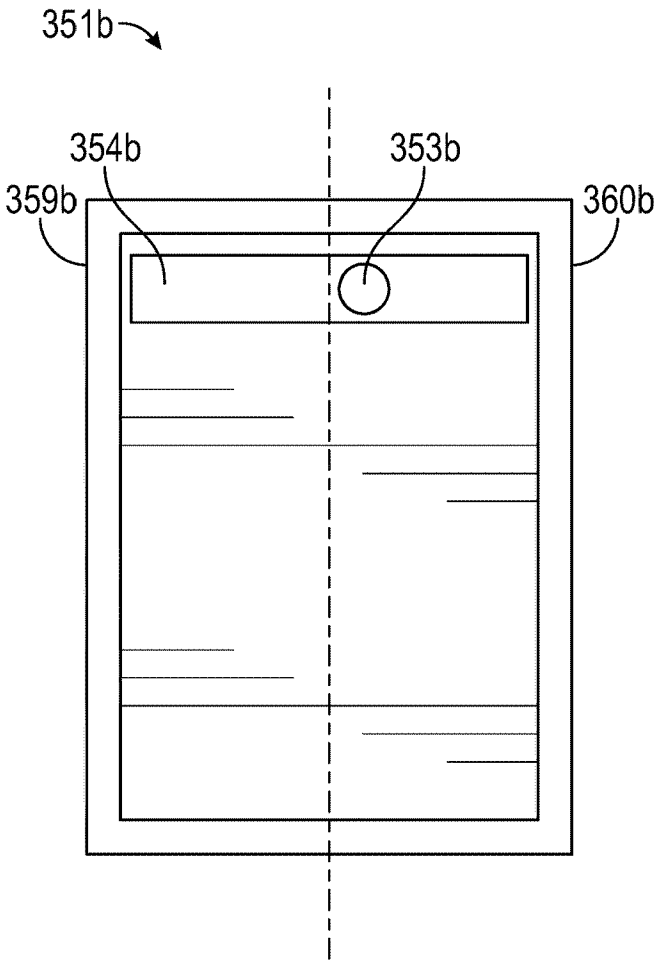
FIG. 3B and FIG. 3C show shower bases having an off-center drain outlet, according to some embodiments.
Figure 3B:
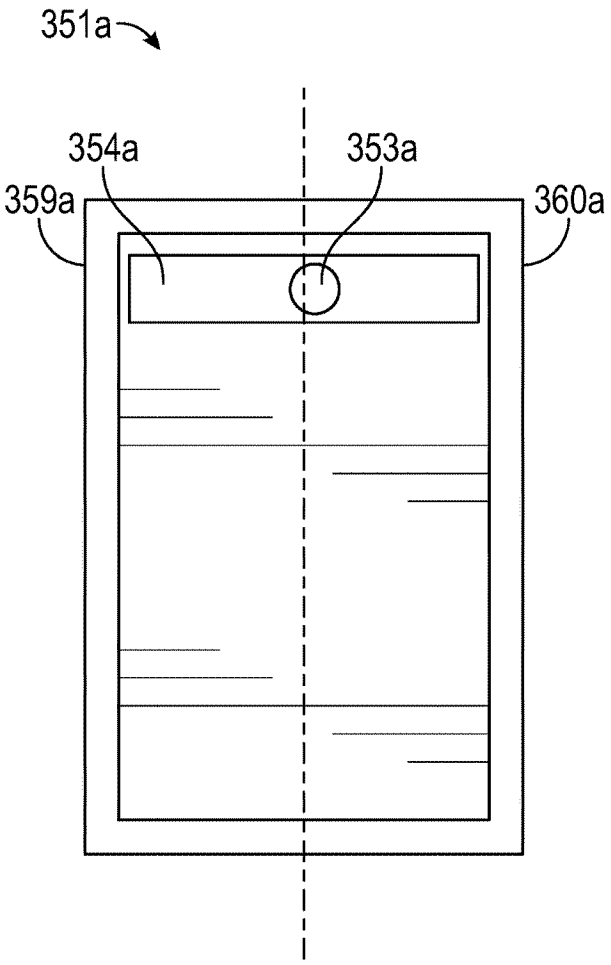
Figure 3A:
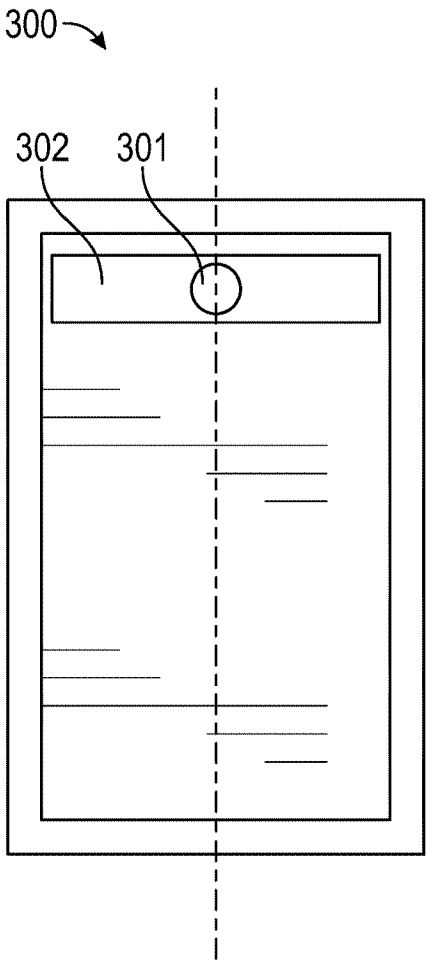
FIG. 3A shows a shower base having a centered drain outlet, according to an embodiment.

FIG. 3A shows shower base 300 having centered drain outlet 301 positioned in drainage channel 302. Shower base 300 may be 60 inches by 30 inches. Shower base 351*a* of FIG. 3B is 60 inches by 32 inches. Drain outlet 353*a* is positioned in drainage channel 354*a*. Drain outlet 353*a* is off-center and is about 2 inches closer to shower base second side 360*a* than to shower base first side 359*a*. Shower base 351*b* of FIG. 3C is 60 inches by 36 inches. Drain outlet 353*b* is positioned in drainage channel 354*b*. Drain outlet 353*b* is off-center and is about 6 inches closer to shower base second side 360*b* than to shower base first side 359*b*. Shower base 351*a* and shower base 351*b* may replace shower base 300 for a larger shower area without moving waste plumbing configured to couple to a shower base drain outlet.

Figure 4:
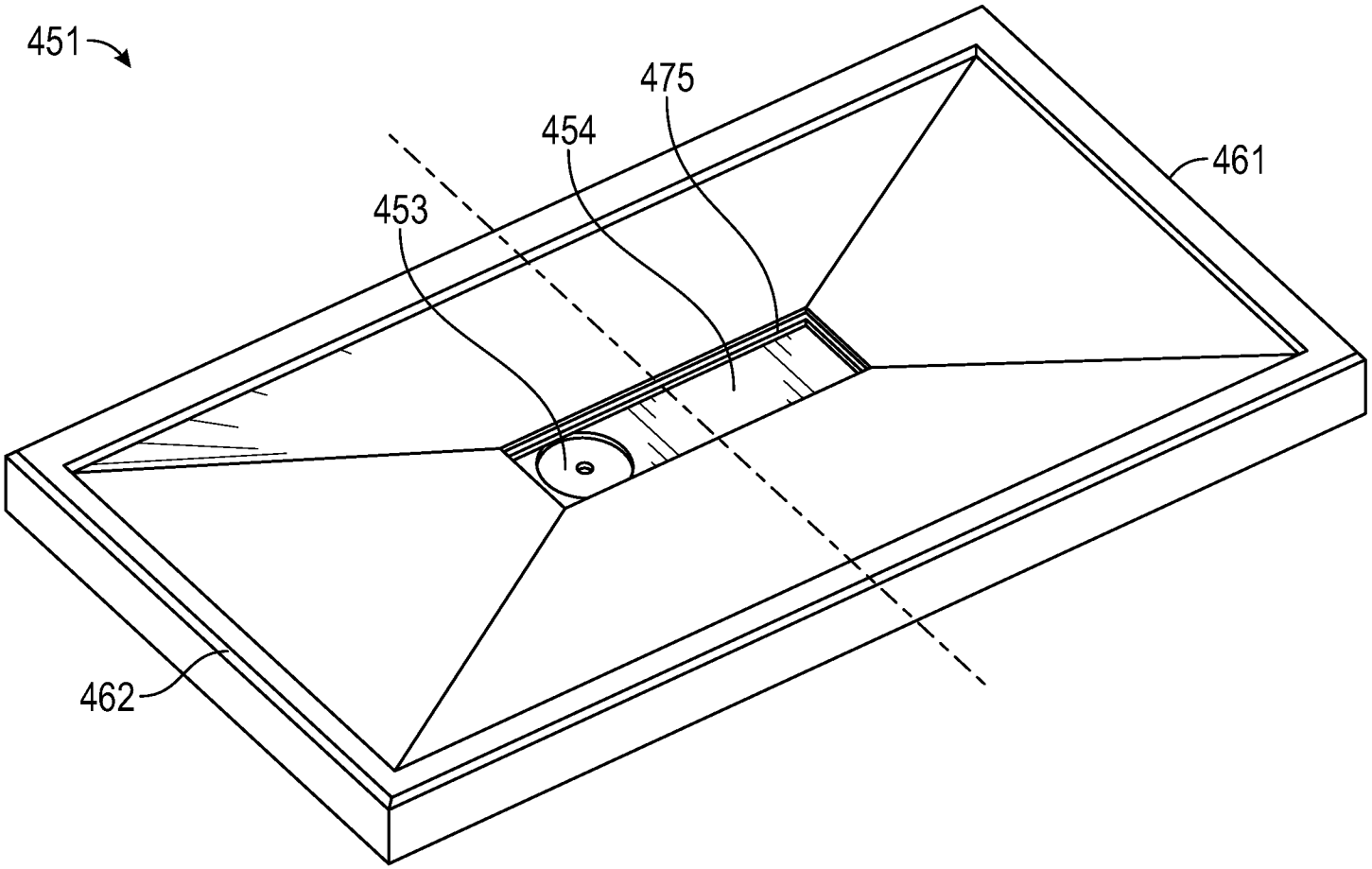
FIG. 4 depicts a shower base having an off-center drain outlet, according to an embodiment.

FIG. 4 shows shower base 451, according to an embodiment. Shower base 451 comprises drainage channel 454, substantially centered in shower base 451 along its length and width. Drainage channel 454 comprises drain outlet 453 positioned adjacent an edge of thereof. Outlet 453 is closer to shower base side 462 than to side 461. Visible is shoulder 475 upon which a drain cover may be removably seated. Drain outlet 453 is positioned off-center along the length of drainage channel 454.

In some embodiments, a shower base may comprise one or more metals, polymeric materials, fiberglass, sheet molding compound (SMC), etc., for example, one or more of an acrylic polymer, a polyurethane, a polyester, a polystyrene, an acrylonitrile-butadiene-styrene (ABS) copolymer, a glass-fiber filled polymer, a resin composite, etc. In some embodiments, a shower base may be formed via injection molding, vacuum forming, compression molding, cast molding, thermo-forming, and the like. A shower base may be a unitary structure or may comprise more than one part.

In some embodiments, molding present shower bases may be accomplished with multiple molding tools for each of different drain offset distances. In other embodiments, molding present shower bases may be accomplished with a single modular tool for the different drain offset distances.

In some embodiments, a drainage channel may comprise a substantially rectangular shape, having a length and width. A drainage channel may comprise a first edge, a second edge, a third edge, and a fourth edge. In some embodiments, drainage channel first and second edges define a drainage channel length and drainage channel third and fourth edges define a drainage channel width.

In some embodiments, a shower base may comprise a substantially rectangular shape having a length and width. A shower base may comprise a first side, a second side, a third side, and a fourth side. In some embodiments, shower base first and second sides define a shower base width and shower base third and fourth sides define a shower base length.

In some embodiments, a drainage channel may be substantially centered within a shower base. A drainage channel may be substantially centered within a shower base wherein a length of a drainage channel is substantially centered along a width of a shower base, that is, a center point of a drainage channel length is substantially aligns with a center point of a shower base width. In some embodiments, a drainage channel first edge is adjacent a shower base first side and a drainage channel second edge is adjacent a shower base second side. When a drainage channel is substantially centered within a shower base, a distance between a shower base first side and drainage channel first edge is substantially the same as a distance between a shower base second side and drainage channel second edge.

A drain outlet of the invention is disposed or positioned in a drainage channel off-center along a length of the channel. In an embodiment, a drain outlet is off-center along a width of a shower base. A distance of a drain outlet to an edge of a drainage channel or a side of a shower base may be measured from a center point of the drain outlet. A drain outlet may be substantially circular. A drain outlet may have an inner diameter of about 2 inches. A drain outlet may be substantially centered along a drainage channel width.

A drain outlet that is "centered" may have a center point that substantially aligns with a reference center point. A drain outlet that is "off-center" may have a center point that is un-aligned with a reference center point.

In some embodiments, a drainage channel is recessed in the shower base, forming a well or sink. In some embodiments, a drainage channel is sloped from the first edge and/or from the second edge towards the drain outlet. In some embodiments, a drainage channel may be sloped from the third edge and/or fourth edge towards the drain outlet.

In some embodiments a shower base may be sloped towards a drainage channel. A slope of a drainage channel or of a shower base may be from any of about 1°, about 2°, about 3°, about 4°, about 5°, or about 6° to any of about 7°, about 8°, about 9°, or about 10°, or more.

In some embodiments, a shower base has a width of about 30 inches, about 32 inches, about 34 inches, about 35 inches, about 36 inches, about 38 inches, about 40 inches, about 42 inches, or more. In some embodiments, a shower base has a length of about 36 inches, about 38 inches, about 40 inches, about 42 inches, about 44 inches, about 46 inches, about 48 inches, about 50 inches, about 52 inches, about 54 inches, about 56 inches, about 58 inches, about 60 inches, about 62 inches, about 64 inches, about 66 inches, about 68 inches, about 70 inches, about 72 inches, or more. Shower base length and width are determined from an outer edge of a shower base.

In some embodiments, drainage channel has a width of from about 3 inches, or about 4 inches to any of about 5 inches, about 6 inches, about 7 inches, about 8 inches, or more. In some embodiments, a drainage channel has a length of from any of about 18 inches, about 20 inches, about 22 inches, about 24 inches, or about 26 inches, to any of about 28 inches, about 20 inches, about 22 inches, about 24 inches, about 26 inches, about 28 inches, about 30 inches, about 32 inches, about 34 inches, about 36 inches, about 38 inches, about 40 inches, or more.

In some embodiments, a drain cover is configured to removably couple to the shower base and will hide the off-center drain outlet. A drain cover may be removed for cleaning of the drainage channel and/or drain outlet and may be returned to an installed position. In some embodiments, a drain cover may comprise a thickness of from any of about 0.20 inches, about 0.23 inches, about 0.26 inches, or about 0.29 inches, to any of about 0.33 inches, about 0.36 inches, about 0.40 inches, about 0.43 inches, about 0.46 inches, about 0.49 inches, about 0.52 inches, about 0.55 inches, about 0.58 inches, about 0.61 inches, or more. In some embodiments, a drain cover may comprise a cast acrylic resin.

In some embodiments, a drain cover may be configured to simply sit on a drainage channel shoulder or ledge. In some embodiments, a drain cover seating may include rubber stand-offs disposed on an underside of the cover and/or on a drainage channel shoulder. In some embodiments, a drain cover may fit snugly over a drain outlet to prevent movement of the cover. In some embodiments, a shower base may comprise a recess or slot into which a drain cover may be partly inserted in order to prevent movement thereof.

In some embodiments, a drain cover may be a solid part. In other embodiments, a drain cover may contain perforations or slots over an entire surface thereof, or over a portion thereof, for instance in a center portion in order to provide an illusion that a drain is centered.

In some embodiments, an installed (coupled) drain cover may provide a passageway for used shower water to flow through to the drainage channel and to the drain outlet. A water passageway may extend around an entire perimeter of a drain cover. Alternatively, a water passageway may only be present towards one edge of a drainage channel (e.g. a fourth edge). In other embodiments, a water passageway may be present along the first, second and third edges of a drainage channel. In some embodiments, a water passageway may be present on a portion of a side of a drain cover, or on an entire side. A water passageway entrance may have a width of from about 0.10 inches to about 0.25 inches.

In some embodiments, a drain outlet may be positioned or disposed in a drainage channel off-center along a length of the channel and closer to a first edge of the channel than the second edge. In other embodiments, a drain outlet may be positioned in a drainage channel off-center along a length of the channel and closer to a second edge of the channel than to a first edge. An off-center drain outlet may be positioned so that it is closer to a shower base first side or to a shower base second side.

In some embodiments, a drain outlet may be about 12 inches, about 13 inches, about 14 inches, about 15 inches, about 16 inches, about 17 inches, about 18 inches, about 19 inches, about 20 inches, about 21 inches, about 22 inches, about 23 inches, about 24 inches, about 25 inches, about 26 inches, or more from the shower base first side. A drain outlet may be about 2 inches, about 4 inches, about 6 inches, about 8 inches, about 10 inches, about 12 inches, or about 14 inches closer to the shower base first side than to the shower base second side. The term "closer" meaning a difference in distance from a drain outlet center point to one side or edge compared to another side or edge.

In some embodiments, a drain outlet may be about 12 inches, about 13 inches, about 14 inches, about 15 inches, about 16 inches, about 17 inches, about 18 inches, about 19 inches, or about 20 inches, about 22 inches, about 23 inches, about 24 inches, about 25 inches, about 26 inches, or more from the shower base second side. A drain outlet may be about 2 inches, about 4 inches, about 6 inches, about 8 inches, about 10 inches, about 12 inches, or about 14 inches closer to the shower base second side than to the shower base first side.

Following are certain non-limiting embodiments of the disclosure.

In a first embodiment, disclosed is a shower base assembly, comprising a shower base having a length and a width; a drainage channel positioned in the shower base; a drain outlet positioned in the drainage channel; and a drain cover configured to cover the drainage channel, wherein the drainage channel comprises a first edge and a second edge defining a drainage channel length, the drainage channel comprises a third edge and a fourth edge defining a drainage channel width, and the drain outlet is positioned in the drainage channel off-center along the drainage channel length.

In a second embodiment, disclosed is a shower base assembly according to the first embodiment, wherein the drainage channel first edge is adjacent a first side of the shower base, and the drainage channel second edge is adjacent a second side of the shower base. In a third embodiment, disclosed is a shower base assembly according to the first or second embodiments, wherein the drainage channel third edge is adjacent a shower base third side.

In a fourth embodiment, disclosed is a shower base assembly according to the first embodiment, wherein the drainage channel is substantially centered in the shower base.

In a fifth embodiment, disclosed is a shower base assembly according to any of the preceding embodiments, wherein the drainage channel length is substantially centered along the shower base length and/or width.

In a sixth embodiment, disclosed is a shower base assembly according to any of the preceding embodiments, wherein the drain outlet is positioned in the drainage channel substantially centered along the drainage channel width.

In a seventh embodiment, disclosed is a shower base assembly according to any of the preceding embodiments, wherein the drain cover is configured to be removably coupled to the shower base. In an eighth embodiment, disclosed is a shower base assembly according to any of the preceding embodiments, wherein the drainage channel is sloped from the first edge and/or from the second edge towards the drain outlet.

In a ninth embodiment, disclosed is a shower base assembly according to any of the preceding embodiments, wherein the drainage channel is sloped from the third edge and/or from the fourth edge towards the drain outlet.

In a tenth embodiment, disclosed is a shower base assembly according to any of the preceding embodiments, wherein the shower base is from about 28 inches to about 42 inches in width and from about 36 inches to about 72 inches in length. In an eleventh embodiment, disclosed is a shower base assembly according to any of the preceding embodiments, wherein the drainage channel is from about 18 inches to about 40 inches in length and from about 3 inches to about 8 inches in width.

In a twelfth embodiment, disclosed is a shower base assembly according to any of the preceding embodiments, wherein the shower base is sloped towards the drainage channel. In a thirteenth embodiment, disclosed is a shower base assembly according to any of the preceding embodiments, wherein the drain outlet comprises about a 2 inch inner diameter.

In a fourteenth embodiment, disclosed is a shower base assembly according to any of the preceding embodiments, wherein the drain cover is configured to provide a passageway for water to flow from a shower base surface towards the drainage channel when coupled to the shower base.

In a fifteenth embodiment, disclosed is a shower base assembly according to any of the preceding embodiments, wherein the drain outlet is positioned in the drainage channel from about 2 inches to about 14 inches off-center along the shower base length or width.

In a sixteenth embodiment, disclosed is a shower base assembly according to any of the preceding embodiments, wherein the drain outlet is positioned in the drainage channel off-center closer to the drainage channel first edge than to the drainage channel second edge.

In a seventeenth embodiment, disclosed is a shower base assembly according to the sixteenth embodiment, wherein the drain outlet is about 14 inches, about 15 inches, about 16 inches, about 17 inches, about 18 inches, about 19 inches, or about 20 inches from the shower base first side. In an eighteenth embodiment, disclosed is a shower base assembly according to embodiments 16 or 17, wherein the drain outlet is about 2 inches, about 4 inches, about 6 inches, about 8 inches, about 10 inches, or about 12 inches closer to the shower base first side than to the shower base second side.

In a nineteenth embodiment, disclosed is a shower base assembly according to any of embodiments 1 to 15, wherein the drain outlet is positioned in the drainage channel off-center closer to the drainage channel second edge than to the drainage channel first edge.

In a twentieth embodiment, disclosed is a shower base assembly according to the nineteenth embodiment, wherein the drain outlet is about 14 inches, about 15 inches, about 16 inches, about 17 inches, about 18 inches, about 19 inches, or about 20 inches from the shower base second side. In a twenty-first embodiment, disclosed is a shower base assembly according to embodiments 19 or 20, wherein the drain outlet is about 2 inches, about 4 inches, about 6 inches, about 8 inches, about 10 inches, or about 12 inches closer to the shower base second side than to the shower base first side.

In a twenty-second embodiment, disclosed is a shower base assembly according to any of the preceding embodiments, wherein the drain cover is coupled to the shower base.

In a twenty-third embodiment, disclosed is a shower base assembly according to any of the preceding embodiments, wherein the shower base is substantially rectangular.

In a twenty-fourth embodiment, disclosed is a shower base assembly according to any of the preceding embodiments, wherein the drainage channel is substantially rectangular.

The term "adjacent" means "near" or "close-by" or "next to".

The term "coupled" means that an element is "attached to" or "associated with" another element. Coupled may mean directly coupled or coupled through one or more other elements. An element may be coupled to an element through two or more other elements in a sequential manner or a non-sequential manner. The term "via" in reference to "via an element" may mean "through" or "by" an element.

Coupled or "associated with" may also mean elements not directly or indirectly attached, but that they "go together" in that one may function together with the other.

The term "flow communication" means for example configured for liquid or gas flow there through and may be synonymous with "fluidly coupled". The terms "upstream" and "downstream" indicate a direction of gas or fluid flow, that is, gas or fluid will flow from upstream to downstream.

The term "towards" in reference to a of point of attachment, may mean at exactly that location or point or, alternatively, may mean closer to that point than to another distinct point, for example "towards a center" means closer to a center than to an edge.

The term "like" means similar and not necessarily exactly like. For instance "ring-like" means generally shaped like a ring, but not necessarily perfectly circular.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more of the definition; for example the term "substantially perpendicular" may mean the 90° perpendicular angle may mean "about 90°". The term "generally" may be equivalent to "substantially".

Features described in connection with one embodiment of the disclosure may be used in conjunction with other embodiments, even if not explicitly stated.

Embodiments of the disclosure include any and all parts and/or portions of the embodiments, claims, description and figures. Embodiments of the disclosure also include any and all combinations and/or sub-combinations of embodiments.

The invention claimed is:

1. A shower base assembly, comprising a shower base having a length and a width;

a drainage channel positioned in the shower base;

a drain outlet positioned off-center in the drainage channel; and a drain cover removably coupled to the shower base, wherein the drain cover is a solid member free of openings directly above the drain outlet and configured to conceal the drain outlet from view so as to create a visual illusion that the drain outlet is centered, the drain cover provides a water passageway extending continuously along at least a majority of a drain cover perimeter for water to flow from a shower base surface to the drainage channel, the drainage channel comprises a first edge and a second edge defining a drainage channel length, the drainage channel comprises a third edge and a fourth edge defining a drainage channel width, the drain outlet is positioned in the drainage channel off-center along the drainage channel length the drainage channel further includes an internal recessed region positioned beneath a solid portion of the drain cover and laterally offset from the water passageway so as to define a blind zone directly beneath the solid member, and the drainage channel includes a first channel floor portion at a first elevation and a second channel floor portion at a lower elevation adjacent the drain outlet, the lower elevation cooperating with the recessed region to direct water entering through the perimeter water passageway along a non-linear flow path toward the drain outlet.

2. The shower base assembly according to claim 1, wherein the drainage channel first edge is adjacent a first side of the shower base, and the drainage channel second edge is adjacent a second side of the shower base.

3. The shower base assembly according to claim 2, wherein the drainage channel third edge is adjacent a shower base third side.

4. The shower base assembly according to claim 1, wherein the drainage channel is substantially centered in the shower base.

5. The shower base assembly according to claim 1, wherein the drainage channel length is substantially centered along the shower base length and/or width.

6. The shower base assembly according to claim 1, wherein the drain outlet is positioned in the drainage channel substantially centered along the drainage channel width.

7. The shower base assembly according to claim 1, wherein the drain outlet is positioned in the drainage channel off-center closer to the drainage channel first edge than to the drainage channel second edge, or is positioned in the drainage channel off-center closer to the drainage channel second edge than to the drainage channel first edge.

8. The shower base assembly according to claim 7, wherein the drain outlet is from about 14 inches to about 20 inches from the shower base first side or from the shower base second side, and is from about 2 inches to about 12 inches closer to the shower base first side or to the shower base second side, than to the shower base second side or to the shower base first side, respectively.

9. The shower base assembly according to claim 1, wherein the water passageway comprises an entrance having a width of from about 0.10 inches to about 0.25 inches.

10. The shower base assembly according to claim 1, wherein the shower base is from about 28 inches to about 42 inches in width and from about 36 inches to about 72 inches in length.

11. The shower base assembly according to claim 1, wherein the drainage channel is from about 18 inches to about 40 inches in length and from about 3 inches to about 8 inches in width.

12. The shower base assembly according to claim 1, wherein the shower base is sloped towards the drainage channel.

13. The shower base assembly according to claim 1, wherein the drain outlet comprises about a 2 inch inner diameter.

14. The shower base assembly according to claim 1, wherein the drain cover water passageway extends around the entire drain cover perimeter.

15. The shower base assembly according to claim 1, wherein the drain outlet is positioned in the drainage channel from about 2 inches to about 14 inches off-center along the shower base length or width.

16. The shower base assembly according to claim 1, wherein the shower base and the drainage channel are substantially rectangular.

17. The shower base assembly according to claim 1, prepared via injection molding, vacuum forming, compression molding, cast molding, or thermo-forming.

18. The shower base assembly according to claim 1, wherein the drain cover water passageway extends along only one edge of the drain cover perimeter.

19. The shower base assembly according to claim 1, wherein the drain cover water passageway extends along a first edge, a second edge, and a third edge of the drain cover perimeter.

20. The shower base assembly according to claim 1, wherein the internal recessed region extends continuously along a portion of the drainage channel length and is positioned laterally between the water passageway and the drain outlet.

* * * * *